US006011471A

United States Patent [19]

Huang

[11] Patent Number: 6,011,471

[45] Date of Patent: Jan. 4, 2000

[54] ALARM SYSTEM

[76] Inventor: Dennis Huang, 5F, No, Lane 9, Ningpo E. St., Taipei, Taiwan

[21] Appl. No.: 09/243,436

[22] Filed: Feb. 3, 1999

[51] Int. Cl.[7] ..... G08B 13/14

[52] U.S. Cl. ..... 340/568.1; 340/539; 340/571; 340/572.8

[58] Field of Search ..... 340/568.1, 568.7, 340/571, 572.1, 686.1, 686.5, 686.6, 539, 572.8

[56] References Cited

U.S. PATENT DOCUMENTS

| | | | |
|---|---|---|---|
| 5,086,290 | 2/1992 | Murray et al. | 340/539 |
| 5,402,104 | 3/1995 | LaRosa | 340/539 |
| 5,627,520 | 5/1997 | Grubbs et al. | 340/572.1 |
| 5,635,897 | 6/1997 | Kuo | 340/539 |
| 5,748,084 | 5/1998 | Isikoff | 340/568.1 |
| 5,757,271 | 5/1998 | Andrews | 340/568.1 |
| 5,781,109 | 7/1998 | Nakajima | 340/568.1 |
| 5,801,627 | 9/1998 | Hartung | 340/568.1 |
| 5,877,686 | 3/1999 | Ibey et al. | 340/571 |

*Primary Examiner*—Jeffery A. Hofsass
*Assistant Examiner*—Van T. Trieu
*Attorney, Agent, or Firm*—Bacon & Thomas

[57] ABSTRACT

An alarm system for an electronic apparatus with a slot comprises a radio transmitter unit and a radio receiver unit. The radio transmitter unit can be carried by a user, including an antenna for transmitting a radio code signal and a control switch for controlling power on/off of the radio receiver unit. The radio receiver includes a security switch controlled to turn on/off the radio receiver unit when inserting/removing from the slot of the electronic apparatus. The radio receiver unit automatically outputs an alarm signal when moved away from the electronic apparatus beyond a predetermined distance due to being incapable of receiving the code signal from the radio transmitter unit.

6 Claims, 4 Drawing Sheets

ALARM SYSTEM

BACKGROUND OF THE INVENTION

The present invention relates to a burglar alarm system for an electronic apparatus with a slot.

Expensive electronic apparatus, such as notebooks computers, personal digital assistants, digital cameras, video cameras, spectrophotometers, waveform monitors and etc., commonly have a slot for receiving a diskette or a card. These expensive electronic apparatus tend to be stolen due to the common characteristics of small size and high value. However, the known alarm system usually requires the above mentioned electronic apparatus to have some modifications. Therefore, a easy and use-friendly alarm system is required.

SUMMARY OF THE INVENTION

It is one object of the present invention to provide a burglar alarm system which can be directly installed with its radio receiver unit in a slot at an electronic apparatus, so that the burglar alarm system automatically outputs an alarm signal when the electronic apparatus is moved beyond the receiving range of the radio transmitter unit of the burglar alarm system. It is another object of the present invention to provide a burglar alarm system which automatically drives its radio receiver unit to alarm when its radio receiver unit is removed from the slot at the electronic apparatus. It is still another object of the present invention to provide a burglar alarm system which automatically obtains power supply from the electronic apparatus for its radio receiver unit when its radio receiver unit is inserted into the slot at the electronic apparatus. It is still another object of the present invention to provide a burglar alarm system which can be used as a regular burglar alarm system when its security switch is disarmed. According to the present invention, the burglar alarm system is designed for use with an electronic apparatus having a slot. The burglar alarm system comprises a radio receiver unit for receiving radio signal, and a radio transmitter unit controlled to transit a code signal. When in use, the radio receiver unit is inserted into the slot at the electronic apparatus under protection, and the radio transmitter unit is carried by the user or installed in a set area. The alarm device of the radio receiver unit alarms when the electronic apparatus is moved away from the user (the radio receiver unit) beyond a predetermined distance, or when the radio receiver unit is taken out of the slot at the electronic apparatus. The radio receiver unit is provided with a security switch such that the alarm device of the radio receiver unit works when the radio receiver unit is taken away from the slot at the electronic apparatus by a thief.

DETAILED DESCRIPTION OF THE PREFERRED EMBODIMENT

Figure 1:
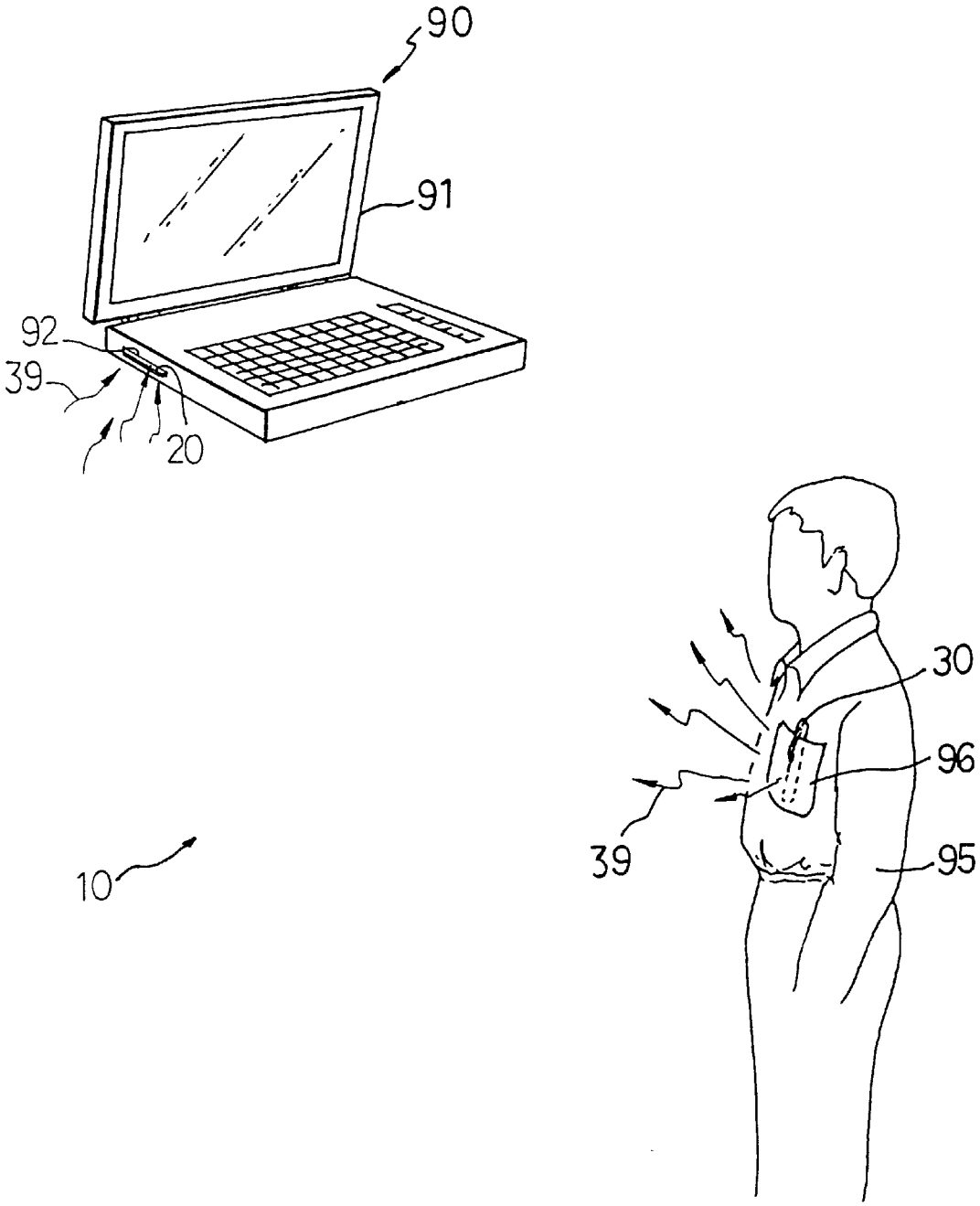
FIG. 1 illustrates an application example of the present invention.

Referring to FIG. 1, a burglar alarm system 10 is designed for use with an electronic apparatus 90 for example, a notebook computer 91. The burglar alarm system 10 comprises a radio transmitter unit 30, and a radio receiver unit 20. When in use, the radio receiver unit 20 is inserted into a slot 92 at the notebook computer 91, and the radio transmitter unit 30 is carried by the user 95, for example in the user's pocket 96. When the notebook computer 91 is moved away from the user 95 beyond a predetermined distance, the radio receiver unit 20 is unable to receive signal from the radio transmitter unit 20, and the alarm device 28 at the radio receiver unit 20 (see FIG. 6) is triggered to alarm.

Figure 2:
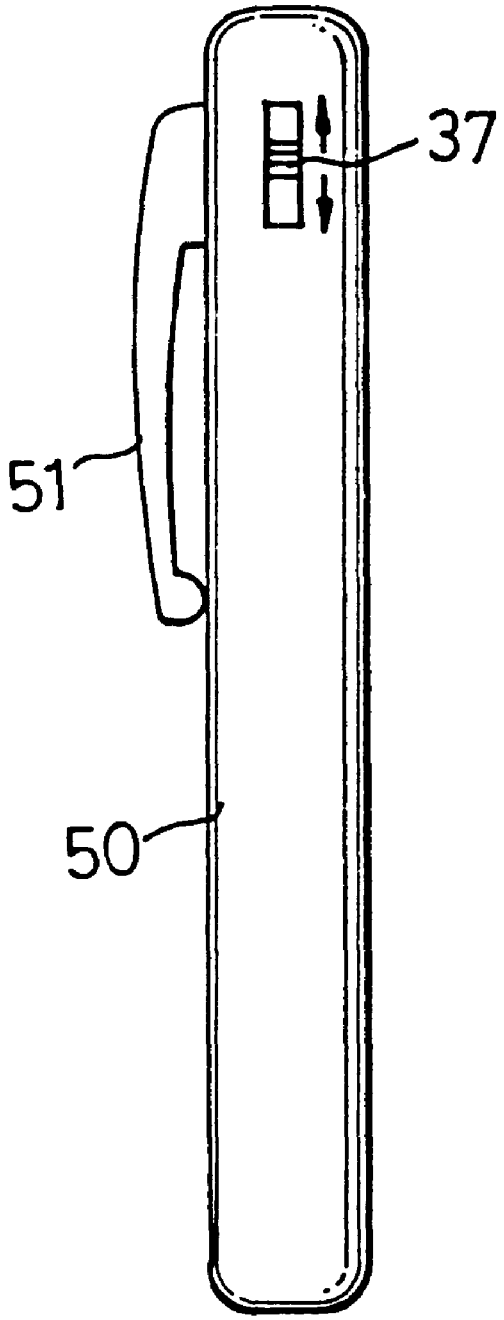
FIG. 2 shows a pen-base radio receiver unit for the burglar alarm system according to the present invention.
Figure 5:
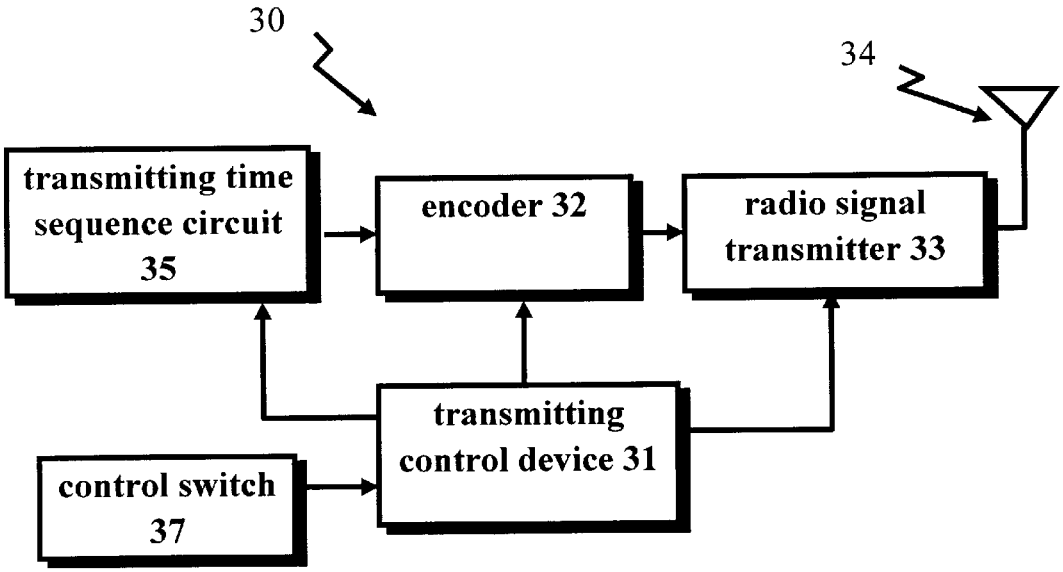
FIG. 5 is a circuit diagram of the radio transmitter unit for the burglar alarm system according to the present invention.

Referring to FIGS. 2 and 5, the radio transmitter unit 30 is comprised of a transmitting circuit formed of an encoder 32, a radio signal transmitter 33, a transmitting antenna 34, a transmitting time sequence circuit 35 and a control switch 37, and a transmitting control device 31, which controls the operation of the transmitting circuit. The control switch 37 controls on/off of the radio transmitter unit 30. When the radio transmitter unit 30 is started, the transmitting control device 31 drives the encoder 32 to output a code signal 39 to the radio signal transmitter 33, enabling the code signal 39 to be transmitted into the air by radio by the radio signal transmitter 33 through the transmitting antenna 34. The radio transmitter unit 30 controls on/off of the radio receiver unit 20 by transmitting a control signal (containing the code signal 39). Therefore, the user 95 who carries the radio transmitter unit 30 can control the operation status of the radio receiver unit 20. In order to save power energy, the transmitting time sequence circuit 38 is provided to control the transmitting frequency of the code signal 39 per every unit time. The transmitting control device 31 can be a microprocessor, or logic circuit means. Because the transmitting control device 31 can be achieved by conventional techniques, it is not described in detail.

For easy carrying by the user 95, the radio transmitter unit 30 can be a pen base radio transmitter unit 50 with a clip 51 (see FIG. 2) for fastening to the pocket 96 (see FIG. 1).

Figure 3:
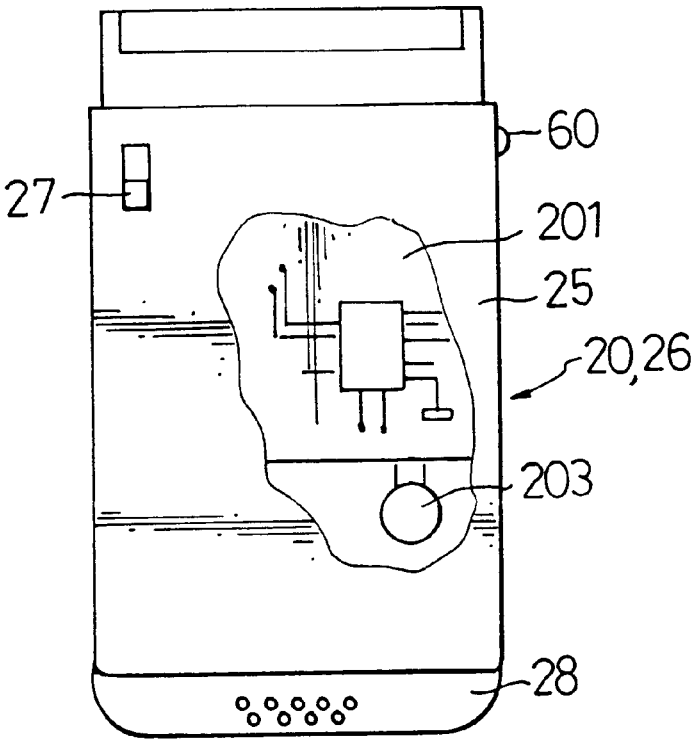
FIG. 3 illustrates a radio receiver unit for the burglar alarm system according to the present invention.
Figure 4:
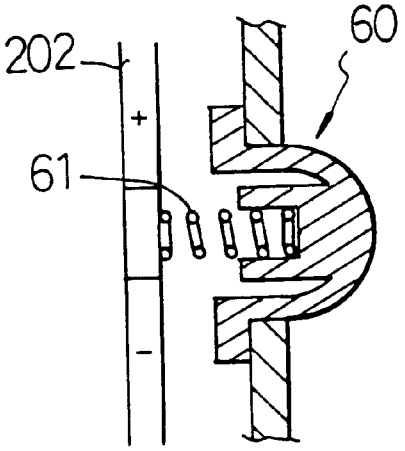
FIG. 4 is an enlarged view of a part of FIG. 3, showing the security switch switched off.
Figure 6:
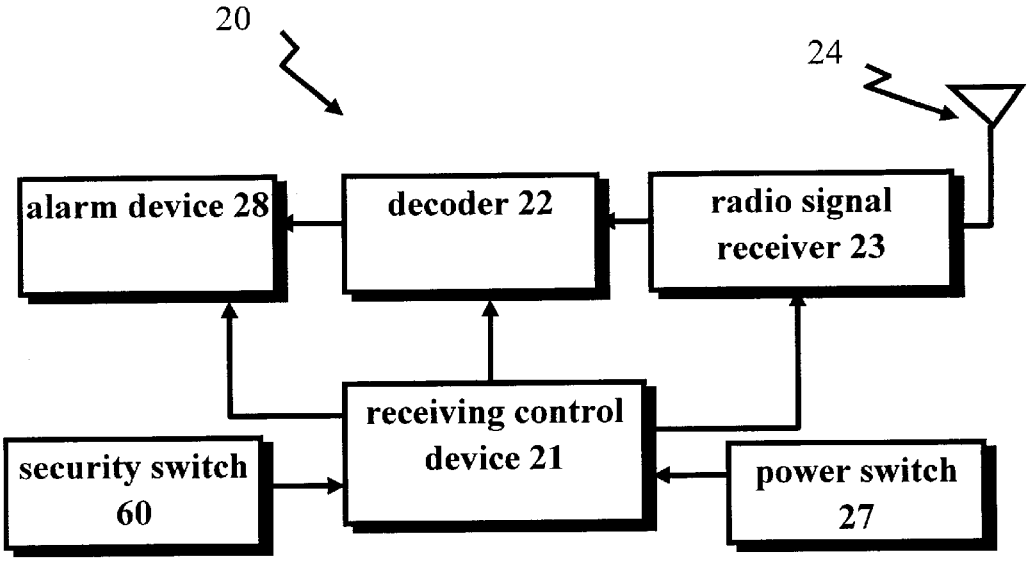
FIG. 6 is a circuit diagram of the radio transmitter unit for the burglar alarm system according to the present invention.

Referring to FIGS. 3, 4 and 6, the radio receiver unit 20 comprises a card-like casing 25 for insertion into the slot 92 at the electronic apparatus 90 to be protected, a power switch 27 mounted on the casing 25 and controlled by the radio transmitter unit 30 to turn on/off power supply of the radio receiver unit 20. Power supply for the radio receiver unit 20 is obtained from a battery 203 (which can be a storage battery). The radio receiver unit 20 can be a card-like receiver unit 26 having the size of a PCMCIA card, or alternatively the size of a 3½" diskette. When the radio receiver unit 20 is inserted into the slot 92, it can obtain power supply from the electronic apparatus 90, for example, the notebook computer 91 provides power supply to its PCMCIA slot 92.

A circuit board 201 is mounted inside the casing 25. The circuit board 201 comprises a receiving circuit formed of a decoder 22, a radio signal receiver 23 and a receiving antenna 24, and a receiving control device 21, which controls the operation of the receiving circuit. The receiving antenna 24 receives external radio signal, and sends received radio signal to the decoder 22 for recognition to check if received signal is the code signal 39 from the radio transmitter unit 30 or not. If the radio receiver unit 20 receives no code signal 39 from the radio transmitter unit 30 after the radio receiver unit 20 and the radio transmitter unit 30 have been turned on, the alarm device 28 of the radio receiver unit 20 immediately outputs an alarm signal. The type of the alarm signal is subject to the function of the alarm device 28. The alarm device 28 can be for example a buzzer disposed outside the slot 92.

Further, a security switch 60 is installed in the casing 25. The security switch is preferably a push button switch. When the card-like receiver unit 26 is inserted into the slot 92 at the notebook computer 91, the security switch 60 is depressed to switch on a switching circuit 202 on the circuit board 201. If the card-like receiver unit 26 is removed from the slot 92 at the notebook computer 91, the security switch 60 is released from the switching circuit 202, and the switching circuit 202 is off, thereby causing the alarm 28 of the radio receiver unit 20 to alarm. When the switching circuit 202 is off, power supply for the alarm 28 is obtained from the battery 203. The switching circuit 202 can be formed of a logic circuit, and controlled by the receiving control device 21. When the user removes the card-like receiver unit 26 from the slot 92 at the notebook computer 91, the user can operate the control switch 37 at the radio transmitter unit 30 to switch off the function of the security switch 60, keeping the burglar alarm function to be maintained in effect. At this time, the card-like receiver unit 26 can be put in a suitcase, enabling the suitcase to be protected, i.e., the radio receiver unit 20 and the radio transmitter unit 30 must be kept within the set distance, or the alarm 28 will output an alarm signal.

While only one embodiment of the present invention has been shown and described, it will be understood that various modifications and changes could be made thereunto without departing from the spirit and scope of the invention disclosed.

What the invention claimed is:

1. A alarm system for use with an electronic apparatus having a slot, comprising:

a radio transmitter unit, said radio transmitter unit comprising a transmitting circuit and a transmitting control device controlling on/off said transmitting circuit, said transmitting circuit comprised of an encoder, a radio signal transmitter, a control switch, and a transmitting antenna, said encoder outputting a code signal to said radio signal transmitter when turned on said transmitting control device, enabling the code signal to be transmitted through said transmitting antenna into the air by radio; and a radio receiver unit for insertion into the slot of the electronic apparatus, said radio receiver unit comprising a casing fitting the slot at the electronic apparatus, a receiving antenna, which receives the code signal from said radio transmitter unit within a predetermined distance between said radio transmitter unit and said radio receiver unit, a decoder, which recognizes the code signal received by said receiving antenna, an alarm device, a receiving control device, which drives said alarm device to output an alarm signal when said receiving antenna receives no signal from said radio transmitter unit, and a security switch controlled to turn on/off said radio receiver unit.

2. The alarm system of claim 1 wherein said radio transmitter unit further comprises a transmitting time sequence circuit, which controls the transmitting frequency of said code signal per every unit time.

3. The alarm system of claim 1 wherein the control switch of said radio transmitter unit controls alert/disarm of said radio receiver unit.

4. The alarm system of claim 1 wherein the control switch of said radio transmitter unit controls power on/off of said radio receiver unit.

5. The alarm system of claim 1 wherein said receiver unit further comprises a switch controlled by said radio transmitter unit to turn on/off power supply of said radio receiver unit.

6. The alarm system of claim 1 wherein the control switch of said radio transmitter unit controls the security switch of said radio receiver unit.

* * * * *